United States Patent [19]

Knell et al.

[11] 3,980,525

[45] Sept. 14, 1976

[54] INCREASING ETHYLENE FEEDSTOCK GASES PRODUCED BY QUENCHING EFFLUENT ZONE ABOVE COKE BED WITH COOLING LIQUID

[75] Inventors: Everett W. Knell, Pleasant Hills Boro, Allegheny County; Philip X. Masciantonio, Penn Township, Westmoreland County; Joseph P. McGinness, McKeesport; George T. Saniga, Penn Hills Township, Allegheny County, all of Pa.

[73] Assignee: United States Steel Corporation, Pittsburgh, Pa.

[22] Filed: Nov. 7, 1974

[21] Appl. No.: 521,811

Related U.S. Application Data

[63] Continuation of Ser. No. 371,108, June 18, 1973, abandoned, which is a continuation of Ser. No. 107,661, Jan. 19, 1971, abandoned.

[52] U.S. Cl. ..... 201/29; 202/260; 208/48 Q; 260/683 R

[51] Int. Cl.[2] ..... C07C 11/02; C07C 11/04; C07C 3/30; C10G 37/02

[58] Field of Search ..... 201/4, 30, 29, 36–38, 201/31, 28; 208/8, 11, 48 Q, 131; 202/254, 260, 261

[56] References Cited

UNITED STATES PATENTS

| | | | |
|---|---|---|---|
| 1,369,673 | 2/1921 | Koppers | 201/38 |
| 1,695,914 | 12/1928 | Burrows | 201/38 |
| 2,006,115 | 6/1935 | Schaefer | 201/38 |
| 2,034,818 | 3/1936 | Loughrey | 208/8 |
| 2,037,587 | 4/1936 | Otto | 201/38 |
| 2,537,153 | 1/1951 | Nelson | 201/4 |
| 2,657,124 | 10/1953 | Gaucher | 208/8 |
| 2,793,173 | 5/1957 | Fritz | 208/48 Q |
| 2,889,265 | 6/1959 | Borey | 208/48 Q |
| 2,906,695 | 9/1959 | Boston | 208/48 Q |
| 3,174,924 | 3/1965 | Clark | 202/260 |
| 3,221,076 | 11/1965 | Frey | 208/48 Q |
| 3,342,724 | 9/1967 | Goering | 208/48 Q |
| 3,663,645 | 5/1972 | Dorn | 208/48 Q |
| 3,796,768 | 3/1974 | Starzeuski | 260/683 R |

FOREIGN PATENTS OR APPLICATIONS

| | | | |
|---|---|---|---|
| 1,040,021 | 10/1958 | Germany | 260/683 R |

*Primary Examiner*—Stephen J. Emery
*Attorney, Agent, or Firm*—David S. Urey

[57] ABSTRACT

A method of and apparatus for increasing yields of certain recoverable gases, particularly ethylene feedstocks, produced during the manufacture of coke from a raw material in a coking apparatus is disclosed.

The method includes the steps of heating the raw material to its coking temperature to cause evolvement of the recoverable gases in an effluent zone in the coking apparatus above the raw material; and simultaneously introducing a cooling fluid into the effluent zone to maintain the temperature of the recoverable gases in the effluent zone below their decomposition temperature, thereby increasing the yield of certain recoverable gases from the coking apparatus while maintaining maximum coke-producing rates in the coking apparatus.

14 Claims, 3 Drawing Figures

INVENTORS
EVERETT W. KNELL, PHILIP X. MASCIANTONIO,
JOSEPH P. McGINNESS & GEORGE T. SANIGA
By
Attorney INVENTORS
EVERETT W. KNELL, PHILIP X. MASCIANOTNIO,
JOSEPH P. McGINNESS & GEORGE T. SANIGA
By
Attorney

INCREASING ETHYLENE FEEDSTOCK GASES PRODUCED BY QUENCHING EFFLUENT ZONE ABOVE COKE BED WITH COOLING LIQUID

This is a continuation, of application Ser. No. 371,108, filed June 18, 1973, now abandoned which is a continuation of Ser. No. 107,661, filed Jan. 19, 1971 (now abandoned).

The apparatus for increasing yields of certain recoverable gases produced during the manufacture of coke from the raw material has a coke producing oven having the raw material in a coking zone and having an effluent zone for the reception of the recoverable gases, heating means associated with the oven for heating the raw material to its cooking temperature to cause evolvement of the recoverable gases in the effluent zone above the raw material; and cooling means in communication with the effluent zone for simultaneously introducing a cooling fluid into the effluent zone to maintain the temperature of the recoverable gases in the effluent zone below their decomposition temperature, thereby increasing the yield of the recoverable gases from certain coking zone while maintaining maximum coke-producing rates in the coking zone.

BACKGROUND OF THE INVENTION

The chemical products resulting from manufacture of metallurgical coke in by-product coke ovens are of significant economic benefit in coke-plant operation inasmuch as the gases, light oil, and tar are valuable raw materials for the plastics, pharmaceutical, and agricultural industries. It is well known that variations in coke-oven operation with regard to operating conditions, design, and coal-charge characteristics have an effect on the amount and type of the products produced.

The principal criterion for coke-plant operation is the production of high-grade metallurgical coke at the lowest possible cost. Therefore, the chemical products that are realized from by-product coke ovens cannot be readily controlled and are subject to variation as a result of the changes in demand for coke. It is desirable to be able to increase the yield of certain chemicals, such as ethylene, when the coke-oven operating rate may be low or high, thereby ensuring an adequate supply to ethylene feedstocks (i.e., ethylene, ethane, propane propylene, propadiene or the like) for operation of chemical facilities based on these raw materials.

Earlier attempts to increase the chemical yield of coke ovens involved changes in operating conditions, such as oven temperatures, coal charge, bulk density, chemical addition to the coal, oil addition to the coal, water addition to the coal, and the like. In general, these techniques had relatively small effects on the chemical yield unless a very large change was made to the variable, and in such a case, a significant deleterious change resulted in the quantity or quality of the coke produced. Furthermore, th cost of adding materials to the coal charge frequently exceeded the value of the incremental chemical yield. In addition, the inclusion of materials in the oven charge generally results in decreasing the amount of coal placed in the oven, thereby reducing the coke production, and also upsets the heat requirement for the completion of coking. Finally, any change in the chemical yield should be such that the general character of the by-products is unchanged inasmuch as the chemical plant facilities associated with the coke ovens have been designed for a previously specified product distribution although it is desirable to be able to vary the proportions of the by-products particularly to be able to increase the proportion of ethylene feedstocks.

Conventional apparatus and methods are shown in the following patents:

| U.S. Patent No. | Inventor | Issued |
|---|---|---|
| 1,530,631 | VanAckeren | 3/24/25 |
| 2,006,115 | Shaefer | 6/25/33 |
| 2,018,664 | Fritz et al | 10/28/35 |
| 2,065,288 | Otto | 12/22/36 |

OBJECTS OF THE INVENTION

It is the general object of this invention to avoid and overcome the foregoing and other difficulties of and objections to prior art practices by the provision of an improved method and apparatus for increasing the yields of certain recoverable gases, such as ethylene, ethane $C_3^+$ hydrocarbons, and the like, from a coke manufacturing oven, which method and apparatus:

a. increase the yield of ethylene feedstocks, such as ethylene, ethane, propane, propylene, propadiene, and the like, from coke ovens without materially affecting the rate of coke production;

b. do not decrease the amount of coal or green petroleum coke placed in the coke oven or the amount of coke produced;

c. do not change the chemical character of the chemical by-products produced in the coke ovens;

d. do not produce deleterious change in the quality or quantity of coke produced;

e. significantly increase yields of certain chemical products obtained by the injection of a cooling fluid into the tunnel head region or effluent zone of a conventional by-product coke oven;

f. inject a cooling fluid into the tunnel head region or effluent zone of a conventional coke oven during the period following the initial devolatization of the coal in the oven and significantly increases the yield of certain chemical products;

g. inject cooling fluid into the tunnel head region or effluent zone of a conventional by-product coke oven at the rate of about 40 to 48 gallons per hour and significantly increases yields of ethylene, ethane, $C_3^+$ hydrocarbons and the like; and h. inject cooling fluid in the tunnel head region or effluent zone of a conventional coke oven during the period following initial devolatization of the coal at an injection rate between about 16 and 48 gallons per hour to increase the yield of ethylene, ethane, $C_3^+$ hydrocarbons or the like by about 30 percent, 160 percent, and 100 percent, respectively, over that realized in conventional coking operations.

BRIEF SUMMARY OF THE INVENTION

The aforesaid objects of this invention, and other objects which will become apparent as the description proceeds, are achieved by providing an improved method of an apparatus for increasing the yield of certain recoverable gases, particularly ethylene feedtocks; produced during the manufacture of coke from a raw material.

The method includes the steps of heating the raw material to its coking temperature to cause evolvement of the recoverable gases in an effluent zone in the coking apparatus above the raw material; and simultaneously introducing a cooling fluid into the effluent zone to maintain the temperature of the recoverable gases in the effluent zone below their decomposition temperature, thereby increasing the yield of certain recoverable gases from the coking apparatus while maintaining maximum coke-producing rates in the coking apparatus.

The apparatus for increasing yields of recoverable gases produced during the manufacture of coke from the raw material has a coke producing oven having the raw material in a coking zone and having an effluent zone for the reception of the recoverable gases; heating means associated with the oven for heating the raw material to its coking temperature to cause evolvement of the recoverable gases in the effluent zone below their decomposition temperature, thereby increasing the yield of certain recoverable gases from the coking zone while maintaining maximum coke-producing rates in the coking zone.

BRIEF DESCRIPTION OF THE SEVERAL VIEWS OF THE DRAWINGS

For a better understanding of this invention, reference should be had to the accompanying drawings, wherein like numerals of reference indicate similar parts through the several views and wherein.

Although the principles of this invention are broadly applicable to increasing the yields of certain recoverable gases during a coking operation, this invention is particularly adapted for use in conjunction with coke derived from coal and from green petroleum coke and hence it has been so illustrated and will be so described.

DETAILED DESCRIPTION

Figure 1:
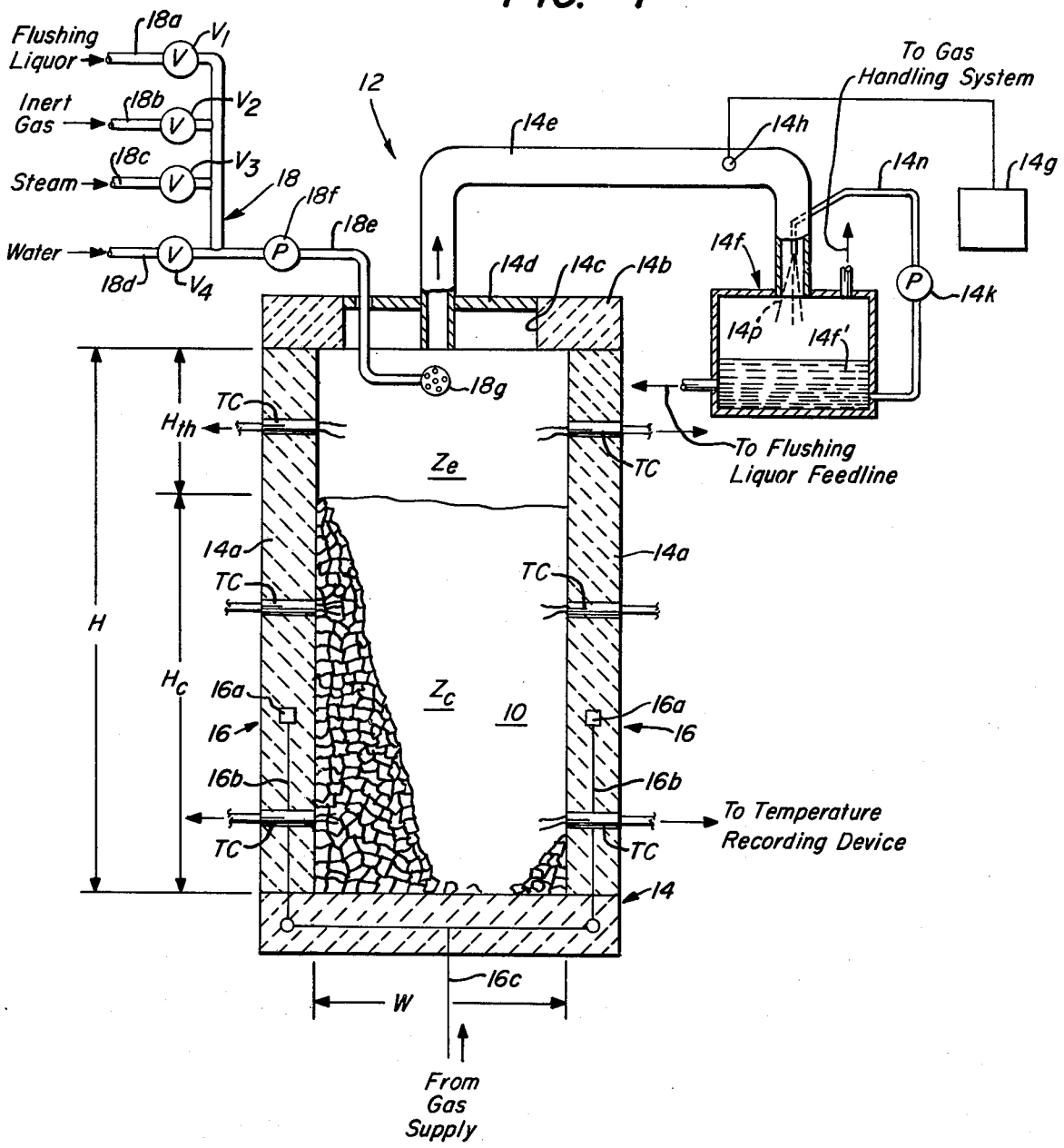
FIG. 1 is a diagrammatic and elevational view, partially in section, of coke oven showing the cooling means of the present invention.
Figure 2:
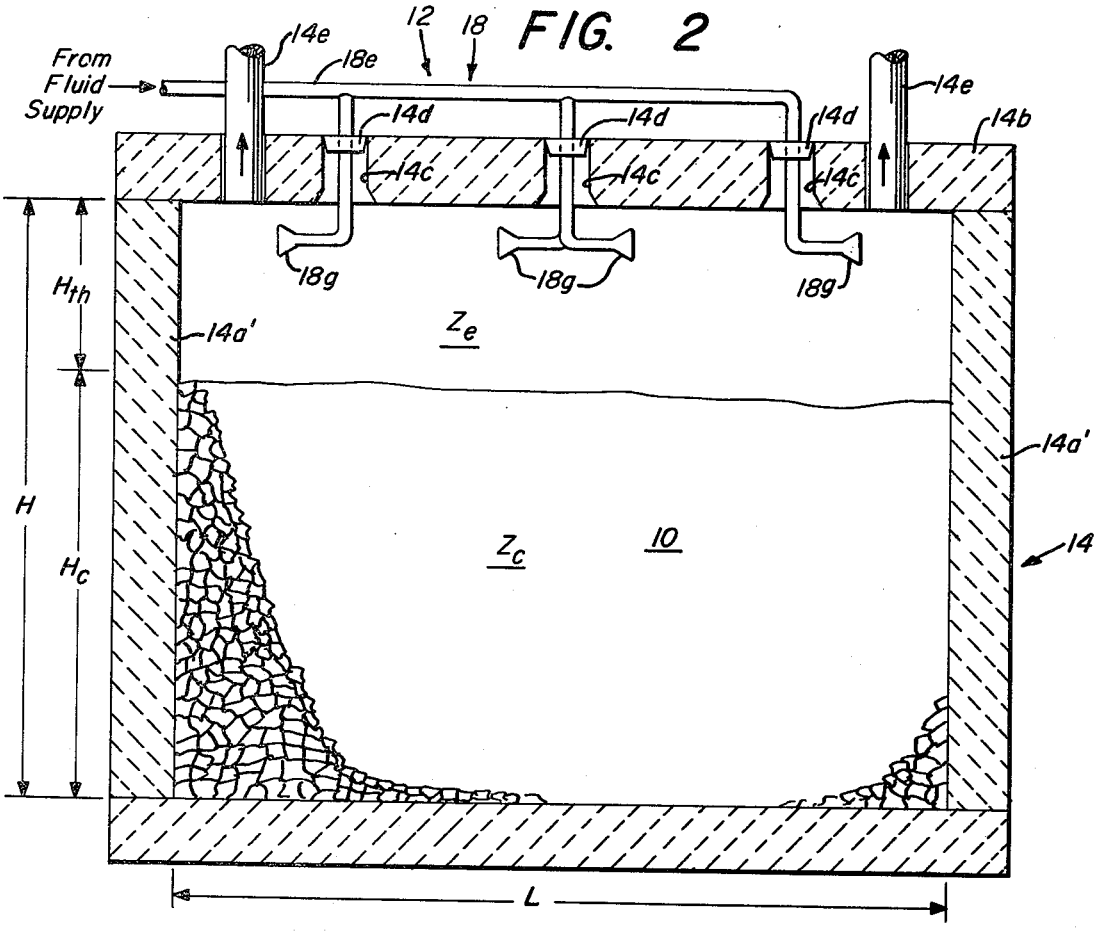
FIG. 2 is a diagrammatic side elevational view, partially in section of the coke oven shown in FIG. 1.

With specific reference to the form of this invention illustrated in the drawings, and referring particularly to FIGS. 1 and 2, an apparatus for increasing yields of certain recoverable gases produced during the manufacture of coke from a raw material, such as coal 10, coal tar soft pitch, or the like, is indicated generally by the reference numeral 12.

The apparatus 12 (FIGS. 1,2) has a coke producing device such as, for example, a conventional coke oven 14 (FIGS. 1 and 2) having the raw material or coal 10 in a coking zone $Z_c$ (FIGS. 1,2) and also having an effluent zone $Z_e$ (FIGS. 1,2) for the reception of recoverable gases, such as (in the case of coke manufactured from coal), ethylene, ethane, propane, propylene, propadiene, or the like. Heating means 16 (FIG. 1) having a plurality of burners 16*a* (FIG. 1) fed by lines 16*b* and 16*c* (FIG. 1) from a burner gas supply (indicated in FIG. 1 by the legend "From Gas Supply") are mounted in the side walls 14*a* of the oven 14 for heating the coal 10 to its coking temperature of about 2000°F to cause evolvement of the recoverable gases in the effluent zone $Z_e$ above the raw material or coal 10.

As shown in FIGS. 1 and 2, the effluent zone $Z_e$ is defined by the coal 10, the side walls 14*a* of the oven 14, doors 14*a'* (FIG. 2) and the roof 14*b*. Such roof 14*b* is provided with a plurality of charging holes 14*c* (FIGS. 1,2) into which the coal 10 is fed from a larry car (not shown). After loading the coal 10 to the predetermined depth $H_c$ (FIGS. 1 and 2), a cover 14*d* (FIGS. 1,2) is applied to each of the charging holes 14*c* preparatory for start of the coke manufacturing operation. During the coking operation, the recoverable gases are fed through gas mains 14*e* (FIGS. 1,2) to a gas collecting system 14*f* (FIG. 1). For the purpose of analyzing the content of the recoverable gases, a gas analyzer 14*g* (FIG. 1) of the continuous gas chromatograph type similar to the type manufactured by Bendix Corporation Process Inst. Div., Ronceverte, West Virginia 29470, has its gas collecting probe 14*h* (FIG. 1) inserted in each of the gas mains 14*e*. A pump 14*k* (FIG. 1) pumps a flushing liquor or coke oven waste fluid 14*f'* from the gas collecting system 14*f* through a line 14*n* to a spray 14*p*.

The raw material or coal 10 deposited in the coking zone $Z_c$ may be, for example, about 16 tons of a mixed blend of 75% Robena coal and 25% Alpheus coal by weight. Such coal may have the following approximate composition shown in Tables IA–IC below:

TABLE IA

Approximate Composition of Coal Blends Consisting of 75 percent Robena and 25 percent Alpheus Coals (both by weight)

| Blend No. | Bulk Density Lbs/ft³ | Volatile Matter, Percent by wt. | Moisture Percent by wt. | Size % ⅛ in[2] |
|---|---|---|---|---|
| 39 | 52.6 | 30.89 | 5.1 | 66.4 |
| 40 | 52.7 | 31.46 | 4.6 | 68.3 |
| 41[1] | 52.7 | 30.69 | 4.4 | 69.3 |
| 43A | 51.9 | 30.30 | 4.8 | 64.3 |
| 43B | 52.3 | 30.40 | 4.7 | 62.6 |
| 43C | 51.9 | 31.46 | No Data | No Data |

[1]Control Blend
[2]Percent of coal that will pass through a ⅛ inch screen

TABLE IB

| Proximate Analysis | Robena As Received % by wt. | Robena Dry Basis % by wt. | Alpheus As Received % by wt. | Alpheus Dry Basis % by wt. |
|---|---|---|---|---|
| Moisture | 7.0 | 0 | 5.8 | 0 |
| Volatile Matter | 33.5 | 36.0 | 16.3 | 17.3 |
| Fixed Carbon | 53.3 | 57.3 | 72.6 | 77.1 |
| Ash | 6.2 | 6.7 | 5.3 | 5.6 |

TABLE IC

| Ultimate Analysis | % by wt. | % by wt. |
|---|---|---|
| Carbon | 79.32 | 85.60 |
| Hydrogen | 5.47 | 4.39 |
| Nitrogen | 1.58 | 1.24 |
| Sulfur | 1.70 | 0.62 |
| Ash | 6.70 | 5.58 |
| Oxygen | 5.23 | 2.57 |

The coking rate in the coking zone $Z_c$ (FIGS. 1,2) may, for example, be about 1⅛ inch per hour; the bulk density of the coal 10 may be about 53 pounds per cubic foot and the final coking temperature may be about 2000°F. The volume $V_c$ of the coal 10 in the coking zone $Z_c$ is equal to $L \times H_c \times W$ (FIGS. 1,2) or about 37.3 feet × 10.4 feet × 1.56'feet or about 605.16 cu. ft. (53 lbs/cu.ft. × 605.16 cu.ft.= 32,073.48 lbs = 16.036 tons.) The volume $V_e$ of the effluent zone $Z_e$ is $L \times H_{th} \times W$, or (for example) about 37.3 feet × 1.5 feet × 1.56 feet or about 87.282 cu. ft.

As shown in Table II below, the coke oven 14 of FIGS. 1,2 may have the following dimensions:

TABLE II

| | Range | Preferred |
|---|---|---|
| H(height of the oven) | 6–20′ | 11.9′ |
| L | 30–42.6′ | 37.3′ |
| W | 12–22″ | 18.68″ |
| $H_c$(height of coal) | 10–20′ | 10.4′ |
| $H_{th}$ | 12–22″ | 18″ |

The flushing liquor or coke oven waste fluid may have the following approximate composition shown in Table III below:

TABLE III

| Compound | Coke Oven Waste Fluid Lbs. |
|---|---|
| $CO_2$ | 640 |
| $NH_3$ | 461 |
| Water | 273,840 |
| Tar acids (phenol, meta, para, cresols, etc.) | 295 |
| Tar bases (quinolins, etc.) | 55 |
| Oil | 18 |
| Tar | 223 |
| $NH_4Cl$ | 1,417 |
| $(NH_4)_2SO_4$ | 414 |
| Other salts | 304 |
| | 277,667 |

The cooling means 18 (FIGS. 1,2) are in communication with the effluent zone $Z_e$ for simultaneously introducing a cooling fluid, such as flushing liquor, an inert gas (such as nitrogen, argon, or the like), steam, water, mixtures thereof, or the like, into the effluent zone $Z_e$ to maintain the temperature of the recoverable gases in the effluent zone $Z_e$ below the decomposition temperature of such recoverable gases thereby increasing the yield of certain recoverable gases in the effluent zone $Z_e$ while maintaining maximum coke producing ranges in the coking zone $Z_c$.

All temperatures of the coke in the coking zone $Z_c$ and of the effluent gases in the effluent zone $Z_e$ are measured by thermocouples TC (FIG. 1).

COOLING MEANS 18

As shown in FIGS. 1 and 2, the cooling means 18 has a plurality of branch inlet lines **18*a*,18*b*,18*c*,18*d* (FIG. 1) extending through valves V1, V2, V3, V4 (FIG. 1) into a feed line 18*e*, (FIGS. 1,2) and a pump 18*f* (FIG. 1) for pumping the cooling fluid to a plurality of spray heads or nozzles 18*g* (FIGS. 1,2**).

Table IV below gives the effect of the cooling fluid addition to the effluent zone $Z_e$ of the coke oven 14.

TABLE IV

Data on Effect of Water Addition in Coke Ovens*

| Water Addition Sequence | Water Addition Rate (gal/hr) | Water Addition Rate Per Ton of Coal (gal/hr/ton) | Coke-Oven-Gas Composition (Vol.%) Ethylene $C_2H_4$ ($CH_2{=}CH_2$) | Ethane $C_2H_6$ ($CH_3{-}CH_3$) | Hydrocarbons ($C_3^+$)* | Tunnel Head Temperature Profile of 0–5 hours (°F) | 6–11 hours (°F) | 12–16 hours (°F) |
|---|---|---|---|---|---|---|---|---|
| None | 0 | 0 | 2.0 | 0.5 | 0.2 | 1586 | 1708 | 1820 |
| | | | | | | 1526 | 1615 | 1755 |
| Throughout coke cycle | 48 | 3 | 2.7 | 1.3 | 0.4 | 1340 | 1510 | 1640 |
| | | | | | | 1300 | 1300 | 1470 |
| Throughout coke cycle | 40 | 2.5 | 2.6 | 1.2 | 0.4 | 1340 | 1440 | 1720 |
| | | | | | | 1390 | 1400 | 1570 |
| During first eight hours of coking cycle | 16 | 1.0 | 2.2 | 0.81 | 0.23 | 1444 | 1605 | 1795 |
| | | | | | | 1416 | 1538 | 1728 |
| During last eight hours of coking cycle | 16 | 1.0 | 2.1 | 0.53 | 0.12 | 1531 | 1662 | 1738 |
| | | | | | | 1520 | 1634 | 1717 |

Note:
$C_3^+$ hydrocarbons are propane $C_3H_8$ ($CH_3{-}CH_2{-}CH_3$); propylene $C_3H_6$ ($CH_2 = CH - CH_3$); and propadiene $C_3H_4$ ($CH_2 = C = CH_2$)

From a consideration of Table IV, it will be apparent that the cooling fluid injection is most effective in the effluent zone $Z_e$ during the early part of the coking cycle, such as from about the first to the eighth hour of coking. However, the addition of the cooling fluid from the initial charging period throughout the approximate sixteen-hour coking cycle appears to have a significant increase in the chemical yield of certain recoverable gases. The amount of cooling fluid added to the coal 10 prior to the charging of the coke oven 14 (FIGS. 1,2) is ineffective to increase the chemical yield of recoverable gases and is limited severly by the adverse effect on coal handling resulting from excess water on the coal particles. The addition of excessive cooling fluid results in incomplete coking, excessive energy requirement for heating the coal in the coking zone $Z_c$, and the production of unacceptable metallurgical coke.

ALTERNATIVE EMBODIMENTS

It will be understood by those skilled in the art that alternatively the cooling fluid may be water, steam, an inert gas such as nitrogen, argon, or the like, coke oven flushing liquor, oil, and mixtures thereof. The cooling fluid may be introduced into the effluent zone $Z_e$ (FIGS. 1,2) by the spraying, dripping, injecting, atomizing, or vaporizing of such cooling fluid.

Figure 3:
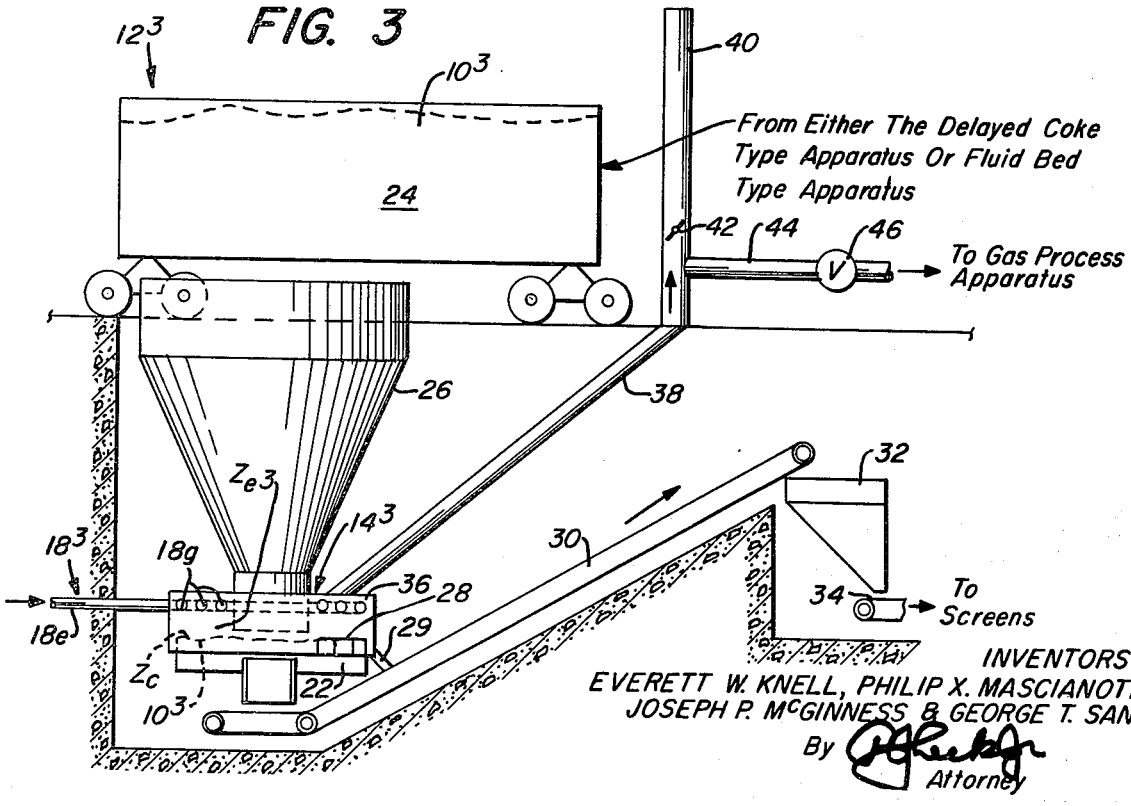
FIG. 3 is a diagrammatic side elevational view of a continuous rotary coking apparatus or calciner for coking green petroleum coke produced from coal tar soft pitch or petroleum residues in either a delayed coking type apparatus or fluid bed type apparatus.

As shown in FIG. 3, the coke producing device may be a rotary continuous calciner 14³ of the type manufactured by Salem-Brosius Company, Pittsburgh, Pennsylvania Such calciner 14³ has a rotary table 22 adapted to receive green or pitch coke from a quencher car 24 via a hopper 26. Rabbles 28 distribute the green or pitch coke 10³ in its circular course of movement from the center of the rotary table 22 to a discharge chute 29 from whence a conveyor 30 carries the now-finished petroleum or pitch coke 10³ to a surge bin 32. The means utilized to deliver the petroleum or pitch coke 10³ to screens (not shown) may suitably be a conveyor 34.

The recoverable gases in the effluent zone $Z_e^3$ are retained in the calciner 14$^3$ by a hood 36. The cooling means 18$^3$ extends through the hood 36 to spray the cooling fluid into the effluent zone $Z_e$. The recoverable gases are withdrawn from the hood 36 by a recoverable gas line 38 extending to a stack 40 where a valve or damper 42 controls the passage of such gases either through the stack 40 or through another gas line 44 and valve 46 to the gas processing apparatus (not shown).

The composition of the coal tar soft pitch, for example, may have the following approximate composition shown in Table V below:

TABLE V

| Inspection of Coal Tar Soft Pitch | |
|---|---|
| Sp.gr., 60/60°F | 1.2225 |
| Viscosity, SFS 180°F | 118.5 |
| SFS 210°F | 38.0 |
| Pour Point, °F | 75 |
| Conradson Carbon, wt% | 31.2 |
| Sulfur, wt% | 0.48 |
| Ash, wt% | 0.018 |
| Naphthalene content, wt% | 1.21 |
| Distillation (TBP°F) | |
| 0 wt% | 431 |
| 10 wt% | 635 |
| 30 wt% | 750 |
| 50 wt% | 900 |
| 67 wt% | 1008 |
| Delayed Coking Yield | wt% of charge |
| Off-gas | 2.4 |
| $C_5$ + Liquid | 47.4 |
| Green coke | 50.2 |
| Total | 100.0 |

The yields from the coal tar soft pitch produced in either a delayed coking apparatus (not shown) or a fluid bed apparatus (not shown) may have the following approximate composition shown in Table VI below:

TABLE VI

| (a) | Delayed Coking Yield | Wt% of Charge |
|---|---|---|
| | Product Gas | 30 |
| | Light Oil | 10.7 |
| | Heavy Oil | 25.4 |
| | Green Coke | 60.9 |
| | | 100.0 |
| (b) | Average Properties of Products | |
| | Product Gas | Vol. % |
| | $H_2$ | 48.2 |
| | $N_2$ | Trace |
| | CO | 1.0 |
| | $CO_2$ | Trace |
| | $CH_4$ (methane) | 44.9 |
| | $C_2H_4$ (ethylene, $CH_2{=}CH_2$) | Trace |
| | $C_2H_6$ (ethane, $CH_3{-}CH_3$) | 5.9 |
| | | 100.0 |
| (c) | Light Oil | |
| | Specific Gravity | 1.018 |
| | Naphthalene Content, wt% | 32.5 |
| | Tar Acid Content, wt% | Trace |
| | Distillation, °C | |
| | IBP | 180 |
| | 10 | 205 |
| | 50 | 235 |
| | 70 | 247 |
| | 90 | 275 |
| | EP | 310 |
| (d) | Heavy Oil | |
| | Specific Gravity | 1.085 |
| | Conradson Carbon, wt% | 0.30 |
| | Pour Point, °C | 40 |
| | Tar Acid Content, wt% | Trace |
| | IBP | 256 |
| | IBP | 265 |
| | 10 | 293 |
| | 50 | 324 |
| | 70 | 338 |
| | 90 | 367 |
| | EP | 400 |
| (e) | Coke | |

TABLE VI-continued

| (a) | Delayed Coking Yield | Wt% of Charge |
|---|---|---|
| | Apparent Density, lb./cu.ft. | 61–69 |
| | Volatile Combustible Matter, wt.% | 7.5–9.5 |

It will be noted from a consideration of Table VI that the recoverable gases in the effluent zone $Z_e^3$ (FIG. 3) are methane, ethylene, and ethane, and that the coking temperature in the calciner 14$^3$ is about 2000°F.

It will be understood that the green coke 10$^3$ (FIG. 3) utilized in the calciner 14$^3$ (FIG. 3) is manufactured from a coal tar soft pitch in either a delayed coking apparatus (not shown) or a fluid bed-type apparatus (not shown).

Alternatively, oil can be injected into the tunnel head $Z_e$ (FIGS. 1,2) $Z_e^3$ (FIG. 3) at a rate of about 1 to 20 gallons per hour consistent with maintaining a temperature range of about 1300°–1500°F in such zone $Z_e$ or $Z_e^3$. It appears that about 15 to 20 gallons per hour is the optimum injection rate. The oil can be injected at any time during the coking cycle. However, the period from about 4 to 16 hours after charging appears most desirable, and the about 8 to 14 hour period is optimum.

Different types of oils can be injected by this technique. However, highly aromatic oils give relatively poor yields, and lowboiling oils impose safety problems and are economically less attractive. An optimum oil is, for example, No. 2 fuel oil, since it is inexpensive, of medium volatility, and very low in aromatics. The composition of the oil used for tests discussed herein can be seen in Table VII below.

TABLE VII

| Approximate Composition of No. 2 Fuel Oil | Specifications | Typical Analysis |
|---|---|---|
| Viscosity, SUS at 100°F | 30 to 45 | 34 to 39 |
| Flash Point, TCC, F | 125 min. | 131 to 165 |
| Specific Gravity, 60°F | — | 0.819 to 0.856 |
| Distillation, Temperature, C | | |
| Start | 177 min. | 175 to 205 |
| 5% Off | | 183 to 224 |
| 50% Off | 288 max. | 224 to 275 |
| 90% Off | | 271 to 326 |
| E.P. | 346 max. | 300 to 345 |
| Percent Carbon (by wt.) | — | 85.7 |
| Percent Hydrogen (by wt.) | | 13.4 |
| Percent Sulfur (by wt.) | | 0.46 |

EXAMPLE 1

A conventional full-size by-product coke oven 14 (FIGS. 1,2) 14$^3$ (FIG. 3) (having dimensions of about 40 feet × 13 feet × 17 inches) is charged with about 17 tons of bituminous coal mixture (about 75% Robena coal and 25% Alpheus coal by weight). To the coal 10 prior to charging is added about 4 pints of No. 2 fuel oil to effect proper bulk density control. The coke 10 (FIGS. 1,2), 10$^3$ (FIG. 3) is subjected to a conventional heating program designed to complete the coking in 16.5 hours, whereupon a final coke temperature of about 2000°F is achieved. The gases evolved during the coking operation are measured and the composition of the gas is determined by continuous gas chromatographic analysis. The ethylene yield is determined to be about 20 lb. per ton of coal 10 charged, and the ethane yield is about 6 lb. per ton of coal 10. The approximate data appear in Table VIII below:

TABLE VIII

| Example | Oil Rate | | Data on Chemical Yield From Oil Injection in Coke Oven Gas Composition (vol.%) $C_2H_4$ | $C_2H_6$ | $C_3$+ | $C_2H_2$ | $CH_4$ | Gas (SCF) Yield ($10^{-3}$) |
|---|---|---|---|---|---|---|---|---|
| 1 | 4.1 | pt/ton | 2.41 | 0.72 | 0.15 | 0.11 | 29.6 | 190 |
| 2 | 8.3 | pt/ton | 2.51 | 0.74 | 0.14 | 0.12 | 30.1 | 194 |
| 3 | 12.3 | pt/ton | 2.39 | 0.60 | 0.11 | 0.13 | 29.4 | 199 |
| 4 | 15.8 | pt/ton | 2.33 | 0.51 | 0.09 | 0.14 | 28.7 | 199 |
| 5 | 19.5 | pt/ton | 2.23 | 0.48 | 0.07 | 0.14 | 28.0 | 199 |
| 6 | 24.6 | pt/ton | 2.13 | 0.53 | 0.10 | 0.17 | 28.7 | 191 |
| 7 | 32.0 | pt/ton | 2.05 | 0.45 | 0.09 | 0.19 | 28.7 | 193 |
| 8 | 40.0 | pt/ton | 2.25 | 0.55 | 0.10 | 0.18 | 26.9 | 194 |
| 9 | 8 | gal/hr | 2.99 | 0.77 | 0.12 | 0.19 | 28.8 | 197 |
| 10 | 20 | gal/hr | 3.60 | 1.11 | 0.36 | 0.20 | 29.9 | 202 |
| 11 | 20 | gal/hr | 4.11 | 1.34 | 0.55 | 0.22 | 30.3 | 197 |

EXAMPLES 2–8

The coking examples 2–8 were conducted as described in Example 1, with the exception that the amount of oil (added to the coal 10 before charging to the oven 14) is increased up to a total of about 40 pints per ton. Data corresponding to the incremental additions can be seen in Table VIII. No significant increase in chemical yield or gas volume is noticeable by the addition of oil to coal 10 prior to charging the oven 14.

EXAMPLE 9

This example was conducted by charging coal 10 to a conventional coke oven 14 (FIGS. 1,2) 14$^3$ (FIG. 3) as described in Example 1. The oven 14, 14$^3$ was modified by inserting nozzles 18*g* (FIGS. 1,2) through the charging holes 14*c* (FIGS. 1,2) into the tunnel head region $Z_2$ of the oven 14. Coking was conducted in the usual manner except that oil is injected into the tunnel head region $Z_e$ (FIGS. 1,2) at the rate of about 8 gallons per hour during the last 8 hours of the coking cycle. Data obtained from the gas evolved during the entire coking cycle can be seen in Table VIII. The concentrations of ethylene and ethane are higher than observed in Examples 1 through 8.

EXAMPLE 10

A conventional full-size by-product coke oven 14 (FIGS. 1,2) (having dimensions of about 40 feet × 13 feet × 17 inches) was charged with a bitmuminous coal mixture (i.e., about 75% Robena coal and 25% Alpheus coal by weight) and is subjected to heating over about a 16.5-hour period to a final coke temperature of about 2000°F. During about the last 8 hours of the coking cycle, a No. 2 fuel oil was injected into the tunnel head region $Z_e$ (FIGS. 1,2of the coke oven 14 at a rate of 20 gallons per hour by means of nozzles 18*g* (FIGS. 1,2) injected through the roof 14*b* of the oven 14. The gaseous products were analyzed and the composition and yields are determined, as shown in Table VIII. The concentrations of ethylene, ethane, and $C_3^+$ hydrocarbons in the coke-oven gas are about 3.60 percent, 1.11 percent, and 0.36 percent, by volume respectively. The yield per ton of coal is about 31.8 lb. $C_2H_4$ (ethylene) and 10.5 lb. $C_2H_6$(ethane), whereas the yield per gallon of added oil is about 3.38 lb. $C_2H_4$ per gallon and about 1.12 lb. $C_2H_6$ per gallon. The net production of ethylene and ethane from the oil is about 11.8 lb. per ton and about 4.1 lb. per ton respectively, or about 1.25 and 0.43 lb. per gallon. The overall yield of about 1.68 lb. of $C_2$ hydrocarbons per gallon of oil is equivalent to a 25 weight percent yield.

EXAMPLE 11

This Example 11 was conducted in the manner described in Example 10 except that oil was injected into the oven 14 (FIGS. 1,2) during the entire coking cycle. The yield of ethylene and ethane is significantly higher (i.e., about 35.2 lb./ton of coal and 12.4 lb./ton coal) than observed in Example 10; however, the net yield per gallon of added oil decreased respectively to about 0.76 lb. per gallon and about 0.3 lb. per gallon. The gas composition was more concentrated in ethylene (about 4.11%), ethane (about 1.34%), and $C_3^+$ hydrocarbons (about 0.55%) as shown in Table VIII.

The oil employed as a cooling fluid not only maintains the temperature of the recoverable gas at about 1300°–1500°F in the effluent zone $Z_e$ (FIGS. 1,2), $Z_e^3$ (FIG. 3) below their decomposition temperature, but also provides a source of such recoverable gases (i.e., ethylene, ethane, propane, propylene, propadiene, methane, and the like).

It will be appreciated by those skilled in the art from the above description of the apparatus 12 shown in FIGS. 1 and 2, and the apparatus 12$^3$ shown in FIG. 3, that an improved method of increasing the yields of certain recoverable gases produced during the manufacture of coke from a raw material has been achieved.

METHOD

This method includes the steps of heating the raw material, such as coal, green petroleum coke, or the like, to its coking temperature of about 2000°F to cause evolvement of the recoverable gases, such as ethylene, ethane, propane, propylene, propadiene, methane and the like, in an effluent zone $Z_e$ (FIGS. 1 and 2) or $Z_e^3$ (FIG. 3) in the coking apparatus 12 (FIGS. 1 and 2) or 12$^3$ (FIG. 3) above the raw material; and then simultaneously introducing a cooling fluid, such as water, steam, inert gas, flushing liquor, oil, and mixtures thereof, into the effluent zone $Z_e$ or $Z_e^3$ to maintain the temperature of the recoverable gases in the range of about 1300°–1500°F in such effluent zone $Z_e$ or $Z_e^3$ below the decomposition temperature of such recoverable gases thereby increasing the yield of certain recoverable gases from the coking apparatus 12 (FIGS. 1,2), 12$^3$ (FIG. 3) while maintaining maximum coke-producing rates in such coking apparatus 12,12$^3$.

SUMMARY OF THE ACHIEVEMENTS OF THE OBJECTS OF THE INVENTION

It will be recognized by those skilled in the art that the objects of this invention have been achieved by providing an improved method of and apparatus 12

(FIGS. 1,2), $12^3$ (FIG. 3) for increasing the yield of recoverable gases produced during the manufacture of coke from a raw material 10 (FIGS. 1,2) $10^3$ (FIG. 3), in a coking apparatus 12,$12^3$, which method and apparatus 12,$12^3$ increase the yield of ethylene feedstocks, such as ethylene, ethane, propylene, propadiene, methane and the like from coke ovens 14 (FIGS. 1,2), $14^3$ (FIG. 3) without materially affecting the rate of coke production; do not decrease the amount of coal or green coke placed in the coke oven or calciner, or the amount of coke produced; do not change the chemical character of the chemical by-products produced in the coke ovens 14,$14^3$; do not produce deleterious change in the quality or quantity of coke produce; significantly increase yields of certain chemical products obtained by injection of cooling fluid into the tunnel head region $Z_e$, $Z_e^3$ of a conventional by-product coke oven 14,$14^3$; inject cooling fluid into the tunnel head region $Z_e$, $Z_e^3$ of a conventional coke oven 14,$14^3$ during the period following the initial devolatization of the coal 10 in the oven 14 and significantly increase the yield of certain chemical products; inject cooling fluid into the tunnel head region $Z_e$,$Z_e^3$ of a conventional by-product coke oven 14,$14^3$ at the rate of about 40 to 48 gallons per hour and significantly increase yields of ethylene, ethane, and $C_3^+$ hydrocarbons; inject cooling fluid in the tunnel head region $Z_e$ of a conventional coke oven 14,$14^3$ during the period following initial devolatization of the coal or green coke at an injection rate between about 16 and 48 gallons per hour to increase the yield of ethylene, ethane, and $C_3^+$ hydrocarbons by 30 percent, 160 percent, and 100 percent, respectively, over that realized in conventional coking operations.

While in accordance with the patent statutes, preferred and alternative embodiments of this invention have been illustrated and described in detail, it is to be particularly understood that the invention is not limited thereto or thereby.

We claim:

1. A method of increasing yields of recoverable ethylene feedstock gases produced and evolved into an effluent zone immediately above and in open communication with a coke bed during the manufacture of coke from a raw material selected from the group consisting of coal, and green or pitch coke in a coking apparatus during a coking cycle, comprising the steps of:

a. heating said raw material to its coking temperature of about 2000°F to cause evolvement of said recoverable gases in the effluent zone in said coking apparatus above said raw material;

b. simultaneously introducing a cooling fluid consisting of liquid water or liquid aqueous flushing liquor into said effluent zone from a location above the coke bed at the rate of about 1.0 to 3.0 gallons/hour/ton of raw material during about the first eight hour period of said coking cycle to maintain the temperature of said recoverable gases in said effluent zone below their decomposition temperature, thereby increasing the yield of said recoverable gases from said coking apparatus while maintaining maximum coke-producing rates in said coking apparatus, said cooling fluid being introduced in a generally horizontal direction and at a distance sufficiently far above the coke that substantially all the fluid is vaporized so that there is no effect on the underlaying coke; and c. continuously withdrawing from said effluent zone said cooled recoverable gases and any injected cooling fluid during said coking cycle.

2. The method recited in claim 1 wherein said cooling fluid is introduced at the rate of about 2.5 to 3.0 gallons/hour/ton of raw material during said cycle.

3. The method recited in claim 1 wherein said coking apparatus is a coke oven.

4. The method recited in claim 1 wherein said temperature of said recoverable gases in said effluent zone is in the range of about 1300°–1500°F.

5. The method recited in claim 1 wherein said coking apparatus is a continuous rotary calciner.

6. The method recited in claim 1 further comprising the step of either spraying, dripping, injecting, atomizing, or vaporizing said cooling fluid into said effluent zone.

7. A method of increasing yields of recoverable ethylene feedstock gases produced and evolved into an effluent zone immediately above and in open communication with a coke bed during the manufacture of coke from a raw material selected from the group consisting of coal, and green or pitch coke in coking apparatus during a coking cycle, comprising the steps of:

a. heating said raw material to its coking temperature of about 2000°F to cause evolvement of said recoverable gases in an effluent zone in said coking apparatus above said raw material;

b. simultaneously introducing a liquid petroleum fraction as a cooling fluid into, said effluent zone from a location above the coke bed at the rate of about 0.06 to 1.2 gallons/hour/ton of raw material during said cycle to maintain the temperature of said recoverable gases in said effluent zone below their decomposition temperature, thereby increasing the yield of said recoverable gases from said coking apparatus while maintaining maximum coke-producing rates in said coking apparatus, said liquid petroleum fraction being introduced in a generally horizontal direction and at a distance sufficiently far above the coke that substantially all the fluid is vaporized so that there is not effect on the underlaying coke; and c. continuously withdrawing from said effluent zone said cooled recoverable gases and any injected cooling fluid during said coking cycle.

8. The method recited in claim 7 wherein said petroleum fraction is introduced during about the fourth to the sixteenth hour of said cycle.

9. The method recited in claim 7 wherein said petroleum fraction is introduced at the rate of about 0.9 to 1.2 gallons/hour/ton of raw material during about the eighth to the fourteenth hour of said cycle.

10. The method recited in claim 7 wherein said coking apparatus is a coke oven.

11. The method recited in claim 7 wherein said temperature of said recoverable gases in said effluent zone is in the range of about 1300°–1500°F.

12. The method recited in claim 7 wherein said coking apparatus is a continuous rotary calciner.

13. The method recited in claim 7 including the step of either spraying, dripping, injecting, atomizing, or vaporizing said cooling fluid into said effluent zone.

14. The method of claim 7 wherein said petroleum fraction is introduced in the second half of the coking cycle.

* * * * *